United States Patent [19]

Folkins

[11] Patent Number: 4,466,732

[45] Date of Patent: Aug. 21, 1984

[54] DEVELOPMENT SYSTEM HAVING A BOUNDED ELECTRICAL BIAS

[75] Inventor: Jeffrey J. Folkins, Fairport, N.Y.

[73] Assignee: Xerox Corporation, Stamford, Conn.

[21] Appl. No.: 392,964

[22] Filed: Jun. 28, 1982

[51] Int. Cl.[3] ..... G03G 15/00

[52] U.S. Cl. ..... 355/14 D; 355/3 DD; 118/657; 118/658

[58] Field of Search ..... 355/14 D, 3 DD; 118/657, 658, 651; 361/235

[56] References Cited

U.S. PATENT DOCUMENTS 4,194,828 3/1980 Hölz et al. ..... 355/3 DD
4,213,693 7/1980 Imai et al. ..... 355/14 D
4,350,440 7/1980 Watanabe ..... 355/3 DD

*Primary Examiner*—G. P. Tolin
*Assistant Examiner*—David Warren
*Attorney, Agent, or Firm*—H. Fleischer; J. E. Beck; R. Zibelli

[57] ABSTRACT

An apparatus in which an image region recorded on a photoconductive surface is developed with a dry developer material. A transport moves the dry material closely adjacent to the photoconductive surface. The charge induced on the transport by the charge on the photoconductive surface is controlled to electrically bias the transport to a potential intermediate the potential of the image region and non-image region of the photoconductive surface.

7 Claims, 3 Drawing Figures

DEVELOPMENT SYSTEM HAVING A BOUNDED ELECTRICAL BIAS

This invention relates generally to an electrophotographic printing machine, and more particularly concerns an apparatus for developing a latent image.

Generally, an electrophotographic printing machine includes a photoconductive member which is charged to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After recording the electrostatic latent image on the photoconductive member, the latent image is developed by bringing dry developer material into contact therewith. This forms a powder image on the photoconductive member which is subsequently transferred to a copy sheet. Finally, the copy sheet is heated to permanently affix the powder image thereto in image configuration.

Various types of dry developer materials may be employed in electrophotographic printing machines. A typical material comprises carrier granules and toner particles. The toner particles adhere triboelectrically to the carrier granules. This two component mixture is brought into contact with the latent image. Toner particles are attracted from the carrier granules to the latent image forming a toner powder image thereof. Different techniques have been employed to improve development of the latent image. For example, cascade systems, fur brush systems, magnetic brush systems and combinations of these systems have heretofore been utilized in electrophotographic printing machines. In cascade systems, an electrode is electrically biased to a potential intermediate that of the background region and image region. This approach is also used in magnetic brush development systems, wherein the developer roller is similarly electrically biased. In this manner, the toner particles are attracted to the image region with development in the background region being substantially suppressed. Other techniques employ a diode electrically connecting a voltage source and developer roller. The diode prevents electrical charge from flowing to neutralize the charge on the photoconductive surface. Alternatively, the developer roller may be electrically insulated from the surrounding environment and allowed to electrically float relative to ground. If the developer roller is allowed to float, a charge is developed on the roller as a result of the background and image charges on the photoconductive surface, as well as any triboelectric charging of the developer roller brush against the photoconductive surface.

Hereinbefore, variations in the electrical potential of the photoconductive surface due to instabilities in charging, exposure and the properties thereof have effected development stability.

Various approaches have been devised to improve development, the following disclosures appear to be relevant:

U.S. Pat. No. 3,599,605
Patentee: Ralston et al.
Issued: Aug. 17, 1971.

U.S. Pat. No. 4,139,299
Patentee: Miyakawa et al.
Issued: Feb. 13, 1979.

The pertinent portions of the foregoing disclosures may be briefly summarized as follows:

Ralston et al. describes a self-biasing electrode system for development of an electrostatic latent image. The developer material contains, in addition to the toner particles, carrier granules which are ferromagnetic and probably conductive. A magnetic brush developer unit having a rotating steel cylinder is positioned adjacent a photoconductive surface. The cylinder is connected to an electrical ground via a variable resistor or a resistor and capacitor arranged in parallel with one another. The charge on the photoconductive surface induces a charge on the cylinder. The electrical circuit retards the flow of the charge from the cylinder and maintains the cylinder at a potential above ground during development of the electrostatic latent image. This circuit also allows a portion of the charge to bleed off so that the cylinder is at a potential less than the potential that would accumulate on the cylinder if it was allowed to electrically float. When the resistance is at infinity, almost no image can be developed on the photoconductive surface by the toner particles. The magnitude of the induced charge is such that if the cylinder is allowed to electrically float, i.e. be electrically insulated from it surroundings, then the charge will build up to the point where sufficient toner particles will not be attracted away from the carrier and cylinder to the electrostatic latent image recorded on the photoconductive surface.

Miyakawa et al. describes a liquid development system for use in an electrophotographic copying machine. A constant current source and a Zener diode are connected in parallel with a developing dish plate. Constant current is passed from the current source to the dish plate. The charge injected into the dish plate, acting as the electrode of a capacitor, will add to the bias potential induced thereon.

In accordance with one aspect of the present invention, there is provided an apparatus for developing an image recorded on a photoconductive surface with a dry developer material. Means transport the dry developer material closely adjacent to the photoconductive surface. Means are provided for controlling the charge induced on the transporting means by the charge on the photoconductive surface to electrically bias the transporting means to a potential intermediate the potential of the image region and non-image region of the photoconductive surface.

Pursuant to another aspect of the present invention, there is provided an electrophotographic printing machine of the type having an electrostatic latent image and a background region on a photoconductive surface. Means transport a dry developer material comprising at least carrier granules and toner particles closely adjacent to the photoconductive surface. The electrostatic latent image attracts toner particles from the carrier granules forming a toner powder image on the photoconductive surface. Means control the charge induced on the transporting means by the charge on the photoconductive surface. In this way, the transporting means is electrically biased to a potential intermediate the potential of the electrostatic latent image and background region on the photoconductive surface.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
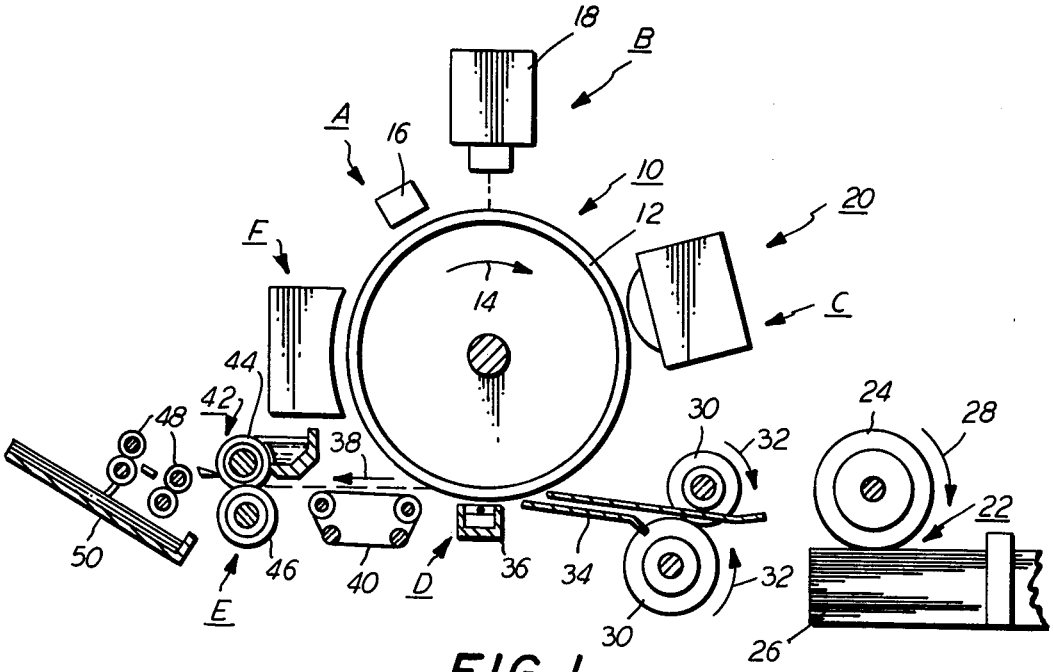
FIG. 1 is a schematic elevational view depicting an electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the development apparatus of the present invention therein. It will become evident from the following discussion that this development apparatus is equally well suited for use in a wide variety of electrostatographic printing machines, and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine utilizes a drum 10 having a photoconductive surface 12. Preferably, photoconductive surface 12 comprises a selenium alloy adhering to a conductive substrate, an electrically grounded aluminum alloy. Drum 10 moves in the direction of arrow 14 to advance photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantially uniform potential. By way of example, photoconductive surface 12 is charged to a positive potential. However, one skilled in the art will appreciate that the apparatus of the present invention will work equally well with a negative potential.

Thereafter, the charged portion of photoconductive surface 12 is advanced through exposure station B. Exposure station B includes an exposure system, indicated generally by the reference numeral 18. Exposure system 18 comprises a light source which illuminates an original document positioned facedown upon a transparent platen. The light rays are reflected from the original document and transmitted through a lens to form a light image thereof. This light image is focused onto the charged portion of photoconductive surface 12 to selectively dissipate the charge thereon. This records an electrostatic latent image on photoconductive surface 12 which corresponds to the informational areas contained within the original document.

After the electrostatic latent image is recorded on photoconductive surface 12, drum 10 advances the latent image to development station C. At development station C, a magnetic brush development system, indicated generally by the reference numeral 20, advances a dry developer material into contact with the electrostatic latent image. The latent image attracts the toner particles from the carrier granules of the developer material to form a toner powder image on photoconductive surface 12 of drum 10. Preferably, the developer material has a conductivity of least $10^{-13}$ centimeters per ohm. The detailed structure of development system 20 will be described hereinafter with reference to FIGS. 2 and 3.

Drum 10 then advances the toner powder image to transfer station D. At transfer station D, a sheet of support material is moved into contact with the toner powder image. The sheet of support material is advanced to transfer station D by a sheet feeding apparatus, indicated generally by the reference numeral 22. Preferably, sheet feeding apparatus 22 includes a feed roll 24 contacting the uppermost sheet of a stack of sheets 26. Feed roll 24 rotates in the direction of arrow 28 to advance the uppermost sheet into the nip defined by forwarding rollers 30. Forwarding rollers 30 rotate in the direction of arrow 32 to advance the sheet into chute 34. Chute 34 directs the advancing sheet of support material into contact with photoconductive surface 12 of drum 10 so that the toner powder image developed thereon contacts the advancing sheet at transfer station D.

Preferably, transfer station D includes a corona generating device 36 which sprays ions onto the back side of the sheet. This attracts the toner powder image from photoconductive surface 12 to the sheet. After transfer, the sheet continues to move in the direction of arrow 38 onto a conveyor 40 which advances the sheet to fusing station E.

Fusing station E includes a fuser assembly, indicated generally by the reference numeral 42 which permanently affixes the transfered toner powder image to the sheet. Preferably, fuser assembly 42 includes a heated fuser roller 44 and a back-up roller 46. The sheet passes between fuser roller 44 and back-up roller 46 with the toner powder image contacting fuser roller 44. In this manner, the toner powder image is permanently affixed to the sheet. After fusing, forwarding rollers 48 advance the sheet to catch tray 50 for removal from the printing machine by the operator.

Invariably, after the sheet of support material is separated from photoconductive surface 12 of drum 10, some residual particles remain adhering thereto. These residual particles are removed from photoconductive surface 12 at cleaning station F. Preferably, cleaning station F includes a rotatably mounted brush in contact with the photoconductive surface. The particles are cleaned from the photoconductive surface by the rotation of the brush in contact therewith. Subsequent to cleaning, a discharge lamp floods the photoconductive surface with light to dissipate any residual electrostatic charge remaining thereon prior to the charging thereof for the next successive imaging cycle.

Figure 2:
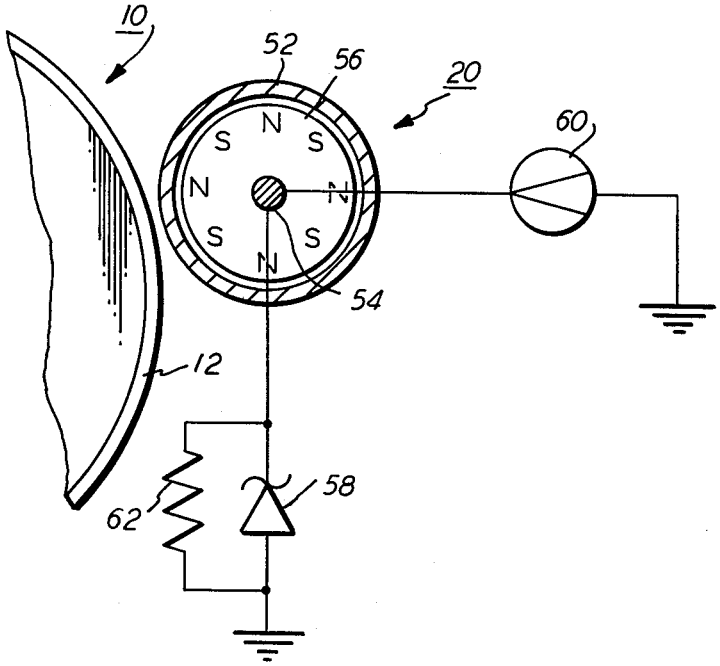
FIG. 2 is a schematic elevational view showing the development system used in the FIG. 1 printing machine.

It is believed that the foregoing description is sufficient for purposes of the present application to illustrate the general operation of an electrophotographic printing machine incorporating the features of the present invention therein. Referring now to FIG. 2, there is shown the detailed structure of development system 20.

As shown in FIG. 2, development system 20 includes a developer roller comprising a non-magnetic tubular roll 52 mounted rotatably on electrically conductive shaft 54. Preferably, tubular member 52 is made from aluminum having the exterior circumferential surface thereof roughened with shaft 54 being made from stainless steel. An elongated magnet 56 is mounted stationarily on shaft 54 and disposed interiorly of and spaced from tubular member 52. By way of example, magnet 56 is made from barium ferrite having a plurality of magnetic poles impressed about the circumferential surface thereof. A diode 58 electrically connects shaft 54 to an electrical ground. Preferably, diode 58 is either a Zener diode or an Avalanche diode. One skilled in the art will appreciate that any diode having a suitable specific breakdown voltage may be employed. A constant current source 60 also electrically connects shaft 54 to an electrical ground. In operation, the constant current source provides a lower limit for the minimum level of electrical bias on tubular member 52 with diode 58 providing an upper limit for the maximum level of electrical bias on tubular member 52. Thus, the electrical bias on tubular member 52 will be bounded and vary between the lower limit established by constant current source 60 and the upper limit established by diode 58. In the region between the limits established by diode 58 and constant current source 60, a charge is induced on tubular member 52 by the charge on photoconductive surface 12 in the background and image regions. The charge induced on tubular member 52 electrically biases tubular member 52 between the potential limits established by diode 58 and constant current source 60. This charge is a function of the electrostatic latent image potential, the distribution of this potential, i.e. the fractional area coverage of the image, the interface between the photoconductive surface and developer material, developer material conductivity and the potential due to the charging of the photoconductive surface against the developer material. The selected diode with its corresponding breakdown voltage determines the upper limit of the electrical bias on tubular member 52. Constant current source 60 maintains the bias potential on tubular member 52 at a voltage level above the voltage level of the background region on photoconductive surface 12. A resistor 62, connected in parallel with diode 58, may be added to the system to mediate any effects of the current on tubular member 52 which depend upon the fractional area of photoconductive surface 12 being developed. However, resistor 62 is not necessary to the operation of the system. Furthermore, a capacitor can be added in parallel with diode 58 to regulate and compensate for any time dependent bias voltage fluctuations which might be due to electrical shorts, temporary loss of charging currents from photoconductive surface 12, or rapidly changing image potentials on the photoconductive surface.

Figure 3:
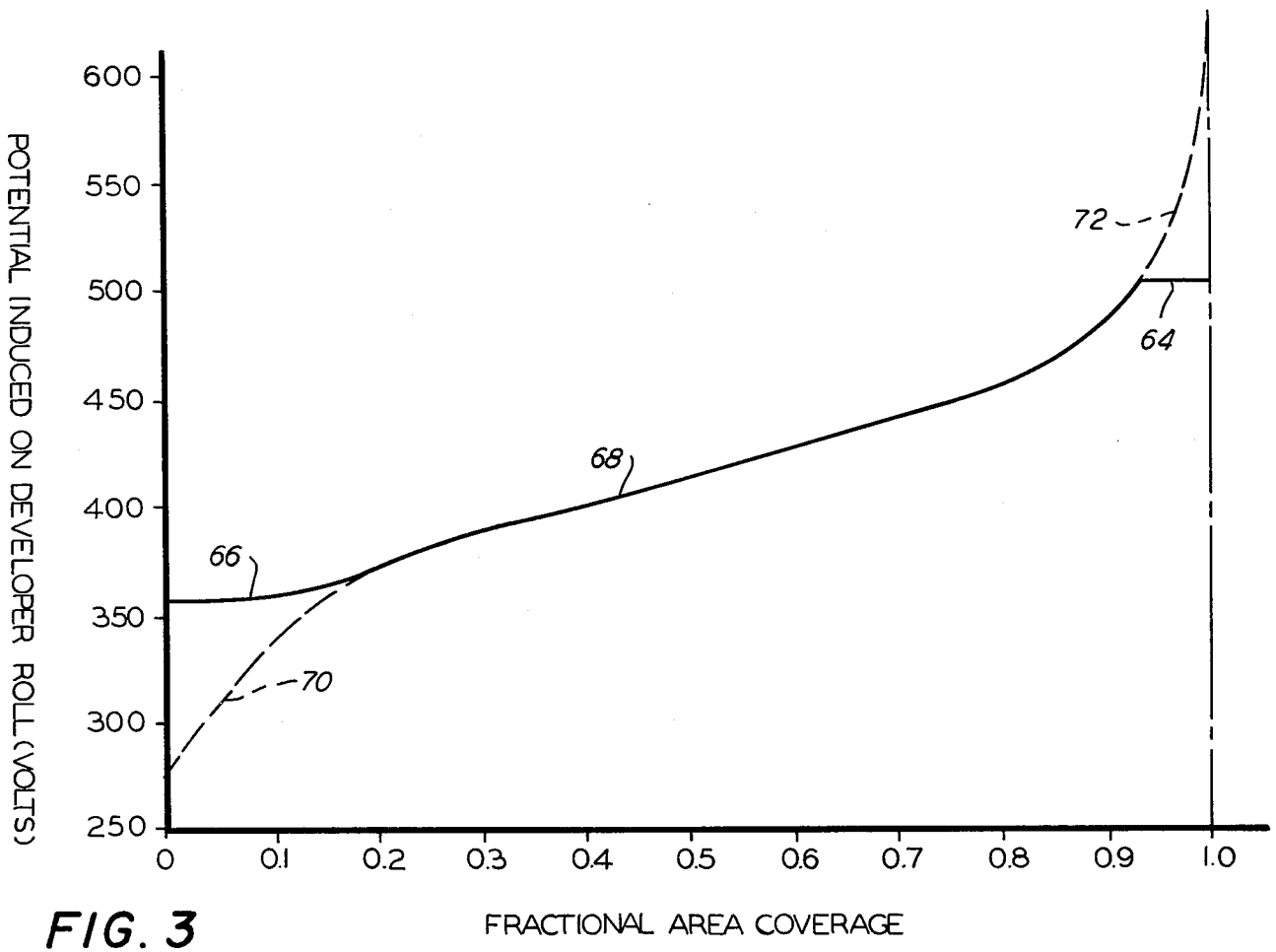
FIG. 3 is an exemplary graph illustrating the electrial bias on the developer roller of the FIG. 2 development system.

Turning now to FIG. 3, there is shown an illustrative graph depicting the electrical potential on the developer roll. If the developer roller is electrically insulated relative to an electrical ground, i.e. electrically floating, the potential thereon varies as a function of the fractional area coverage of the image on the photoconductive surface directly in contact with the developer material. Curve 68, 70 and 72 represents an exemplary plot. The shape and position of this curve is determined by the flow of charge due primarily to the direct charge exchange between the photoconductive surface and developer material, and the triboelectric interaction therebetween. Under these circumstances, the potential on the developer roller is not necessarily at a proper level to insure adequate development. To insure adequate development, it is necessary to introduce upper and lower limits on the potential of the developer roller. In this way, the potential of the developer roller is maintained at an appropriate level to produce satisfactory development. The effect of diode 58 on curve 68, 70 and 72 is to cause the potential on the developer roll to cut-off at an upper limit as shown by line 64. Current source 60 provides a lower limit on curve 68, 70 and 72 as shown by line 66. Thus, the potential on the developer roller will follow curve 64, 66 and 68 when the developer is electrically connected to a diode and current source, as shown in FIG. 2. The conductivity and shape of the current/voltage characteristics of the developer material has a significant effect upon the shape of lines 66, 68, 70 and 72 of the curve of FIG. 3. As the developer material conductivity increases, lines 66 and 70 are lowered and approach more closely the potential of the background region on the photoconductive surface.

By way of example, one skilled in the art will appreciate that a varistor or a conventional diode in series with a voltage source, or any combination of active or passive circuit elements which serve to limit the potential on the developer roller to a selected fixed potential may be employed in lieu of a Zener or Avalanche diode. The constant current may be approximated by a high voltage source connected in series to a resistor of sufficiently high resistance to produce a current source having favorable current voltage characteristics.

The system could operate without the constant current source 60. Under these circumstances, no lower limit would be established. Thus, the electrical bias on the developer roller would continue along line 70. For very low fractional area coverage, the electrical bias might be very close to the background potential. Alternatively, if diode 58 were omitted from the circuitry, the electrical bias on tubular member 52 would continue to follow line 72 and eventually, when the fractional area being developed on the photoconductive surface approached 1 would, itself, approach the highest potential of the latent image.

Preferably, the developer material employed in development system 20 is conductive having a conductivity of at least $10^{-13}$ centimeters per ohm and includes carrier granules having a ferromagnetic core overcoated with a non-continuous layer of resinous material. Suitable resins include poly (vinylidenefluoride) and poly (vinylidenefluorodeco-tetra-fluoroethylene). The developer materials can be prepared by mixing the carrier granules with toner particles. Generally, any of the toner particles known in the art are suitable for mixing with the carrier granules. Suitable toner particles are prepared by finely grinding a resinous material and mixing it with a coloring material. By way of example, the resinous material may be a vinyl polymer such as a polyvinyl chloride, a polyvinylidene chloride, a polyvinyl acetate, polyvinyl acetals, polyvinyl ether and polyacrylic. Suitable coloring materials may be, amongst others, Chromogen Black and Solvent Black. The developer material comprises about 95% to 99% by weight of carrier granules and from about 5% to 1% by weight of toner particles. These and other materials are disclosed in U.S. Pat. No. 4,076,857 issued to Kasper et al. in 1978, the relevant portions thereof being hereby incorporated into the present application.

In recapitulation, it is clear that the development apparatus of the present invention has a developer roller for transporting a dry developer material into a development zone. The developer roller is electrically connected by a suitable diode to ground. In this way, the potential on the photoconductive surface induces a charge on the developer roller which forms an electrical bias that varies until reaching an upper limit defined by the diode. In addition to the diode, a constant current source can be connected between an electrical ground and the developer roller. The constant current source defines a lower limit to the minimum electrical bias on the developer roller. Thus, the electrical bias on the developer roller is bounded and varies as a function of the charge induced thereon by the photoconductive surface between an upper limit defined by a diode and a lower limit defined by a constant current source.

It is, therefore, evident that there has been provided in accordance with the present invention, an apparatus for improving development of an electrostatic latent image with a dry developer material. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An electrophotographic printing machine of the type having an electrostatic latent image and a background region on a photoconductive surface, wherein the improvement includes:

a tubular member mounted rotatably for moving a dry developer material comprising at least carrier granules and toner particles closely adjacent to the photoconductive surface so that the electrostatic latent image attracts toner particles thereto forming a toner powder image on the photoconductive surface;

means for attracting the developer material to said tubular member; and means for controlling the charge induced on said tubular member by the charge on the photoconductive surface to electrically bias said tubular member to a potential intermediate the potential of the electrostatic latent image and background region on the photoconductive surface, said controlling means comprising means for limiting the maximum potential induced on said tubular member to an upper limit, and means for limiting the minimum potential induced on said tubular member to a lower limit relative to the photoconductive surface.

2. A printing machine according to claim 1, wherein said minimum limiting means includes a constant current source electrically connecting said transporting means to an electrical ground.

3. A printing machine according to claim 2, wherein said maximum limiting means includes a diode having a specified level of electrical breakdown voltage electrically connecting said transporting means to an electrical ground.

4. A printing machine according to claim 3, wherein said minimum limiting means includes a constant current source electrically connecting said transporting means to an electrical ground.

5. A printing machine according to claim 4, wherein said maximum limiting means includes an electrical resistor connected in parallel with said diode.

6. A printing machine according to claim 5, wherein the photoconductive surface is made preferably from a selenium alloy.

7. A printing machine according to claim 6, wherein the developer material is magnetic having a conductivity of at least $10^{-13}$ centimeters per ohm and said attracting means includes an elongated magnetic member disposed interiorly of and spaced from said tubular member.

* * * * *